US008590990B2

(12) United States Patent
Friesenecker

(10) Patent No.: US 8,590,990 B2
(45) Date of Patent: Nov. 26, 2013

(54) FURNITURE FLAP DRIVE THAT CAN BE SWIVELED OPEN

(75) Inventor: Gerald Friesenecker, Lauterach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/293,383

(22) Filed: Nov. 10, 2011

(65) Prior Publication Data

US 2012/0056521 A1 Mar. 8, 2012

Related U.S. Application Data

(63) Continuation of application No. PCT/AT2010/000159, filed on May 10, 2010.

(30) Foreign Application Priority Data

May 13, 2009 (AT) ..... A 734/2009

(51) Int. Cl.
*A47B 95/02* (2006.01)

(52) U.S. Cl.
USPC ..... 312/319.6; 312/327; 16/286

(58) Field of Classification Search
USPC ..... 312/319.5–319.8, 327, 328, 325, 312/322–323; 16/286; 49/197, 199, 201
See application file for complete search history.

(56) References Cited

U.S. PATENT DOCUMENTS

| | | | | |
|---|---|---|---|---|
| 5,931,514 | A * | 8/1999 | Chung | 292/89 |
| 2002/0046441 | A1 | 4/2002 | Brustle | |
| 2004/0239213 | A1* | 12/2004 | Hirtsiefer | 312/109 |
| 2005/0146250 | A1* | 7/2005 | Chung et al. | 312/7.2 |
| 2006/0103276 | A1* | 5/2006 | Salice | 312/323 |
| 2006/0284530 | A1* | 12/2006 | Hollenstein | 312/327 |
| 2007/0085453 | A1* | 4/2007 | Zhang et al. | 312/7.2 |
| 2008/0054771 | A1* | 3/2008 | Brunnmayr | 312/323 |
| 2008/0122332 | A1 | 5/2008 | Brustle | |
| 2008/0209682 | A1* | 9/2008 | Dubach et al. | 16/319 |
| 2010/0026153 | A1 | 2/2010 | Mattle | |
| 2010/0043595 | A1 | 2/2010 | Mattle | |
| 2010/0327717 | A1* | 12/2010 | Huber et al. | 312/319.5 |

FOREIGN PATENT DOCUMENTS

| | | |
|---|---|---|
| AT | 505 613 | 3/2009 |
| DE | 20 2006 000 535 | 4/2006 |
| EP | 1 199 433 | 4/2002 |
| WO | 2006/099645 | 9/2006 |

(Continued)

OTHER PUBLICATIONS

International Search Report issued Sep. 15, 2010 in International (PCT) Application No. PCT/AT2010/000159.

(Continued)

*Primary Examiner* — Darnell Jayne
*Assistant Examiner* — Ryan A Doyle
(74) *Attorney, Agent, or Firm* — Wenderoth, Lind & Ponack, L.L.P.

(57) ABSTRACT

The invention relates to a furniture flap drive comprising an electric drive having an electric motor and a mechanical actuating unit having an actuating arm, the mechanical actuating unit and the electric drive being separate components and being releasably fastenable to each other. The actuating unit has a bearing in which the electric drive can be suspended, the suspended electric drive being swivelable about the bearing towards the actuating unit. A locking device is mounted at a distance to the bearing and can be used to lock the electric drive, in a preferably releasable manner, with the actuating unit once the latter has been swiveled open.

20 Claims, 19 Drawing Sheets

(56) References Cited

FOREIGN PATENT DOCUMENTS

| | | |
|---|---|---|
| WO | 2008/134785 | 11/2008 |
| WO | 2008/134786 | 11/2008 |
| WO | 2009/079671 | 7/2009 |

OTHER PUBLICATIONS

Austrian Patent Office Search Report completed Feb. 24, 2010 in Austrian Patent Application No. A734/2009.

* cited by examiner

FURNITURE FLAP DRIVE THAT CAN BE SWIVELED OPEN

This application is a Continuation of International Application No. PCT/AT2010/000159, filed May 10, 2010, the entire disclosure of which is incorporated herein by reference.

BACKGROUND OF THE INVENTION (1) Field of the Invention

The invention concerns a furniture flap drive comprising an electric drive having an electric motor and a mechanical actuating unit having an actuating arm, wherein the mechanical actuating unit and the electric drive are separate components and can be releasably fastened together.

(2) Description of Related Art

WO 2008/134786 A1 discloses a flap mounted movably to a furniture carcass and having a mechanical actuating unit which has an actuating arm which can be connected to the flap and a force storage means acting on the actuating arm. In addition an electric drive in the form of a separate component can be fastened to the actuating unit, wherein fastening is possible even when the actuating unit is already mounted to the furniture carcass.

Depending on the respective furniture flap type, different mechanical actuating units are used, which differ in particular in the configuration of the actuating lever or the lever mechanism of which the actuating lever is a part in order to be able to perform the respective characteristic movement of the furniture flap. The mechanical actuating unit is usually also always provided with a spring pack which serves to compensate for or calibrate for the weight of the furniture flap within certain limits.

In that case arranging the mechanical actuating unit on the furniture carcass can be effected at various locations thereon. Situations can occur there, in particular when the corresponding furniture carcasses are arranged at overhead height, where subsequent fastening of the electric drive is difficult to do. That applies all the more when, as is hitherto usual, the electric drive is screwed to the actuating unit, for which purpose through holes are provided in the actuating unit and in the electric drive.

Therefore the object of the invention is to avoid that disadvantage and provide a simple fixing option for fastening the electric drive to the actuating unit.

BRIEF SUMMARY OF THE INVENTION

The above-described object is attained by a furniture flap drive having the following features.

The furniture flap drive according to the invention has an electric drive which includes an electric motor and is in the form of a component separate from the mechanical actuating unit which includes an actuating arm. Both components, that is to say the electric drive and the mechanical actuating unit, are releasably fastened to each other, wherein the electric drive can also be fastened to the actuating unit even when the actuating unit is already mounted to the furniture carcass. That permits replacement of a defective electric drive without having to remove the mechanical actuating unit from the furniture carcass.

Insofar as the actuating unit now has a bearing, i.e. a mounting location in which the electric drive can be suspended, that permits initial coarse positioning of the electric drive on or at the actuating unit without any screws having to be fitted into through holes for that purpose.

Insofar as it is now further provided that the suspended, i.e. engaged electric drive is swivelable or pivotable towards the actuating unit, in which case the actuating unit can already be mounted to the furniture carcass, more accurate positioning of the electric drive is made possible by a simple swiveling movement, starting from the electric drive being in the engaged condition. The electric drive and the actuating unit can already be connected together by that pivotal movement.

To prevent release, that is to say detachment, of the electric drive from the actuating unit, there is provided a locking device which is remote from the bearing and which permits fixing of the electric drive connected to the actuating unit, wherein the electric drive can be locked to the actuating unit after being swiveled thereonto. It is preferably provided in that respect that the locking device has means with which the locking action is releasable. The locking device can have both components arranged on or at the electric drive and also components arranged on or at the actuating unit.

Instead of having to use a plurality of fastening screws for fixing the electric drive to the actuating unit in an awkward fashion, in which case they possibly have to be screwed together in positions which involve difficult access, fastening and possibly also fixing of the electric drive to the actuating unit is made possible in accordance with the invention in a simple manner by a movement with which the electric drive can be hangingly engaged, i.e. suspended to the actuating unit and subsequent swiveling movement into the suspended condition.

Further advantageous configurations of the invention are defined in the claims.

In a preferred embodiment of the invention the actuating unit has a short axis which is arranged perpendicularly to a long axis of the actuating unit, the long axis of the actuating unit facing in the direction of the longitudinal extent thereof. The short axis thus faces in the direction of the transverse extent of the actuating unit, which is shorter than the longitudinal extent. According to the invention it is now provided that the suspended electric drive is swivelable about the short axis towards the actuating unit. In this case the short axis can be arranged substantially vertically in the mounted position of the actuating unit.

This embodiment is particularly advantageous if the actuating unit is already mounted to the side wall of the furniture carcass and is therefore disposed in particular in the mounted position. In that case the short axis can be oriented parallel to the side wall and to the rear wall of the furniture carcass, to which the actuating unit is fastened. In general mechanical actuating units for furniture flaps are so designed that the actuating arm is arranged in the front part, that is to say in the region of the furniture flap which is to be opened, and extends lengthwise in the rear region of the furniture carcass. Particularly in the case of furniture flaps arranged at a great height, with actuating units extending in the longitudinal direction, subsequent mounting of an electric drive can therefore be difficult. If the bearing which is remote from the locking device is arranged in the rear region, that pivotability about the short axis of the actuating unit is particularly advantageous as the electric drive only has to be suspended, i.e. engaged in regions of the short transverse extent and in that case the swiveling movement can be effected in the direction of the locking device which is preferably arranged in the front region. That facilitates subsequently arranging an electric drive on the actuating unit.

In an embodiment of the invention the locking device is in the form of a mechanical latching connection. It can be provided for that purpose that the locking device has a latching element which is arranged on the electric drive or the actuating unit and which can then be brought into engagement with a holding element arranged on or at the actuating unit or the electric drive. The holding element is therefore arranged on the respective other one of those components, on or at which the latching element is disposed. If the latching element is arranged on the electric drive then an associated holding element is arranged on the actuating unit, and vice-versa.

In that respect it is particularly preferably provided that the mechanical latching connection is of a self-latching nature. For that purpose it can be provided that the latching connection has a snap-action connection and the electric drive is locked on the actuating unit by the corresponding components of the locking device being brought into engagement by pressing in the direction of the pivotal movement. In that case the electric drive can be clipped onto the actuating unit in the region of the locking device. The locking device in that case can have a touch-latch functionality, that is to say it can be released again by further pressing on the electric drive in the direction of the actuating unit.

A latching element which is possibly provided can be brought into engagement in that case in a corresponding holding element with a self-latching or self-locking action, by the latching element being pressed onto the holding element. A possible configuration of such a latching element represents a latching pawl.

For that purpose it can be provided that parts of the locking device, that is to say for example the latching element, are of a resilient nature or are spring-loaded. It can further be provided in that case that the latching connection can be brought out of engagement by pressure in opposite relationship to the spring force. In that way the locking device can be releasable and the electric drive can be unlocked from the actuating unit and ultimately released or detached.

In a further embodiment of the invention the locking device has locking element and a corresponding holding element or abutment element, wherein the locking element can be brought into engagement with the holding element or abutment element. The latching element can be arranged on or at the electric drive and the associated holding element can be arranged on or at the actuating unit, or vice-versa. In that case the locking element can be moved into at least two positions, one of the positions being a locking position in which the locking element is in engagement with the holding element or abutment element in such a way that detachment or release of the electric drive from the actuating unit is no longer possible. The other position is an unlocking position in which it is possible to arrange the electric drive on the actuating unit for fastening those two components or for releasing those components again.

In that respect it is particularly preferably provided that the at least one locking element is mounted rotatably and can be brought into engagement by a rotary movement with the associated holding element or abutment element. In that case the locking element can be actuated by an actuating device, wherein that actuating device is preferably arranged on or at a locking lever which is part of the locking device and which can itself be mounted rotatably. The locking device can be moved by the locking lever into the corresponding locking position. Movement into an unlocking position can also be possible.

The mounting location, i.e. the bearing is arranged remote from the locking device. An embodiment of the invention provides that the bearing has at least one abutment element which for example can be in the form of an abutment edge. That abutment element can be brought into engagement with one or more corresponding holding noses arranged on the electric drive. For that purpose the holding noses are displaced over or into the abutment elements in such a way that the electric drive is hung in the actuating unit and can be swiveled about that position. In that case the holding noses bear against the abutment elements. In principle the reversed arrangement is also possible, in which case the holding nose or noses is or are arranged on the actuating unit and the abutment elements on the electric drive. The holding nose or the abutment elements serve as holding elements for the suspended electric drive.

In a further embodiment of the invention the actuating unit or the electric drive has a centering device so that no play can occur when fastening the electric drive to the actuating unit and the components can be positioned exactly on each other. In that respect it can be provided that the centering device includes a centering pin and a receiving opening corresponding thereto, wherein the centering pin is arranged on the electric drive and the receiving opening in the actuating unit or vice-versa.

The invention further concerns an article of furniture comprising a furniture carcass and a flap mounted movably to the furniture carcass, wherein a furniture flap drive according to the invention is arranged on one or both sides of the furniture carcass and the actuating arm of the furniture flap drive is connected to the flap.

In that respect it can be further provided that a mechanical actuating unit with force storage means and actuating arm is admittedly arranged at both sides, but only one of those actuating units is connected to an electric drive according to the invention.

BRIEF DESCRIPTION OF THE DRAWINGS

Further details and advantages of the present invention will be apparent from the Figures and the related specific description, in which.

DETAILED DESCRIPTION OF THE INVENTION

Figure 1:
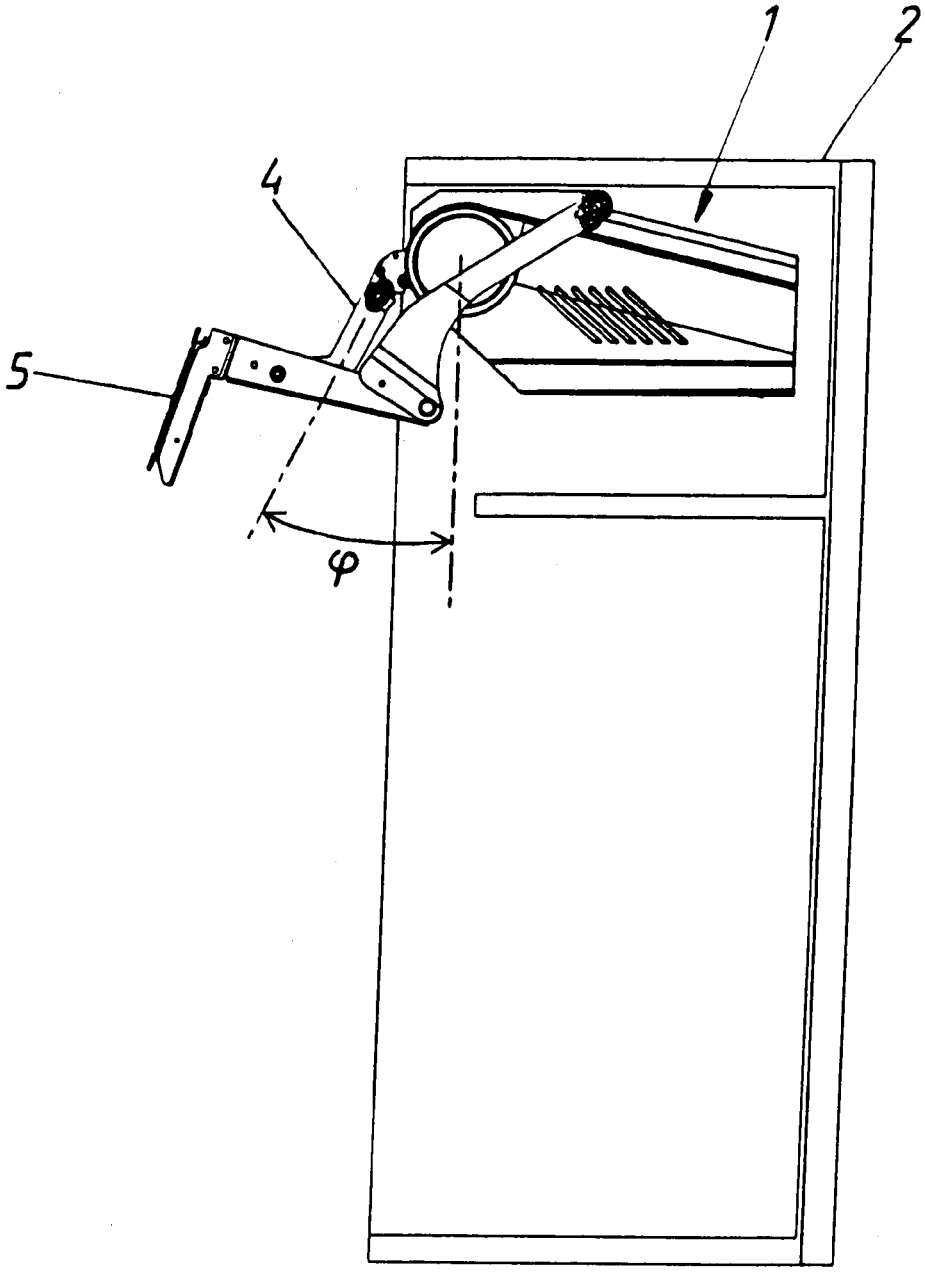
FIG. 1 shows a side view of a furniture flap drive.

FIG. 1 shows a side view of a furniture flap drive 1 which is mounted to a furniture carcass 2 and which includes a mechanical actuating unit 8 and an electric drive 7. The mechanical actuating unit 8 has an actuating arm 4 which in turn includes a plate 5 to which a furniture flap 3 can be fastened. The opening angle ϕ is measured in this case between two notional straight lines of which one extends parallel to the longitudinal extent of the actuating arm 4. The second straight line extends at least approximately vertically and through the pivot point of the actuating arm 4.

The actuating arm 4 is acted upon by a force storage means which is generally in the form of a spring pack. The mechanical actuating unit 8 and the electric drive 7 themselves are known per se in the state of the art and therefore do not have to be described in greater detail.

This embodiment of the lever mechanism of the actuating unit 8 serves as a so-called upwardly pivotable flap in which the furniture flap 3 is pivoted rearwardly over the furniture carcass 2. It will be appreciated that the invention can also be used for further types of flap such as for example so-called upwardly foldable flaps or upward lift flaps. Such flap types are known per se in the state of the art and are described in greater detail for example in DE 20 2006 000 535 U1.

Figure 2A:
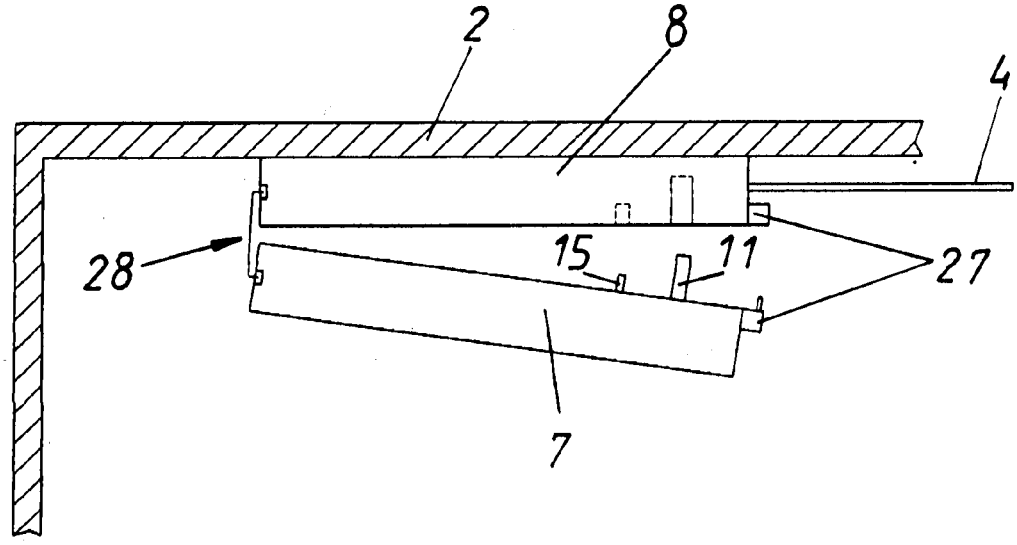
FIGS. 2*a* and 2*b* show a diagrammatic view of the working steps for fastening an electric drive to an actuating unit of a furniture flap drive according to the invention.

FIG. 2*a* diagrammatically shows the operating principle of the invention. The electric drive 7 has means with which it can be suspended or hangingly engaged in the actuating unit 8. The actuating unit 8 is already mounted to the furniture carcass 2. The electric drive 7 is hung in position in the rear region of the actuating unit 8, on the side towards the rear wall of the furniture carcass 2, which would be accessible only with difficulty for making a screw connection. The suspension or the hanging engagement operation itself however can be easily implemented. The electric drive 7 which is suspended in the actuating unit 8 is then swiveled in the direction indicated by the arrow towards the actuating unit 8, the swiveling movement being about the bearing 28 at which the electric drive 7 is suspended into the actuating unit 8. The electric drive 7 has a force transmission device 11 which transmits the force made available by the electric motor to the actuating unit 8 and thereby moves the actuating arm 4 for the opening or closing movement. A centering pin 15 serves for centering the electric drive 7 so that it can be exactly positioned and can be connected without play to the actuating unit 8. The suspended electric drive 7 is swiveled in the direction towards the mounted actuating unit 8 about the short axis which is parallel to the side wall and the rear wall of the furniture carcass 2. The locking device 27 is arranged in the front region of the furniture carcass while the bearing 28 is arranged in the rear region. In that way the electric drive 7 which is suspended in the rear region of the actuating unit 8 in regions of its transverse extent is pivoted about the short axis, in this case arranged vertically, of the actuating unit 8, the pivot points being arranged in the rear region of the furniture carcass 2. Such an embodiment facilitates subsequently arranging the electric drive 7 on the actuating unit 8 as suspension engagement is necessary only in regions of the transverse extent of the actuating unit 8.

Figure 2B:
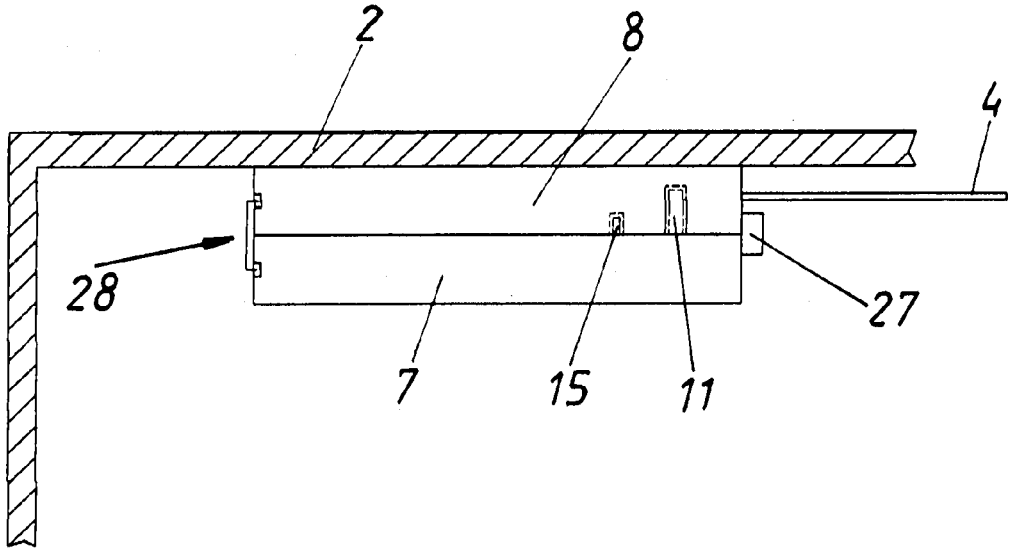

FIG. 2*b* diagrammatically shows how the electric drive 7 and the actuating unit 8 are now connected after the electric drive 7 has been swiveled towards the actuating unit 8. A locking device 27 serves in that case to lock the actuating unit 8 and the electric drive 7 in that position, that is to say to fix same.

Figure 3A:
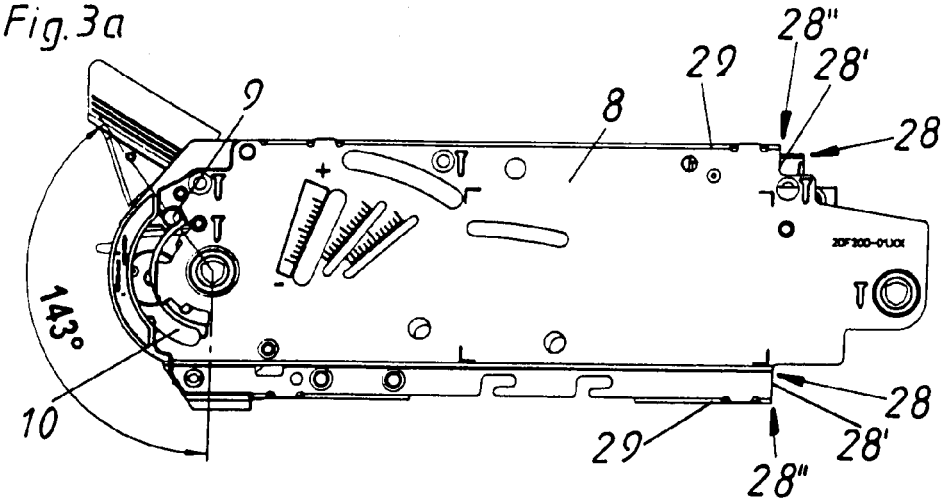
FIGS. 3*a* through 3*c* show side views of three actuating units of differing configurations for moving different types of furniture flap.
Figure 3B:
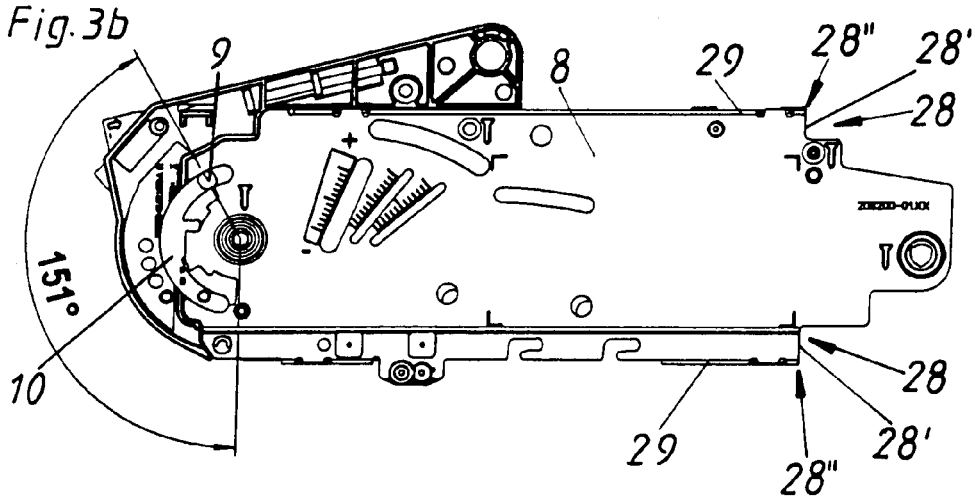
Figure 3C:
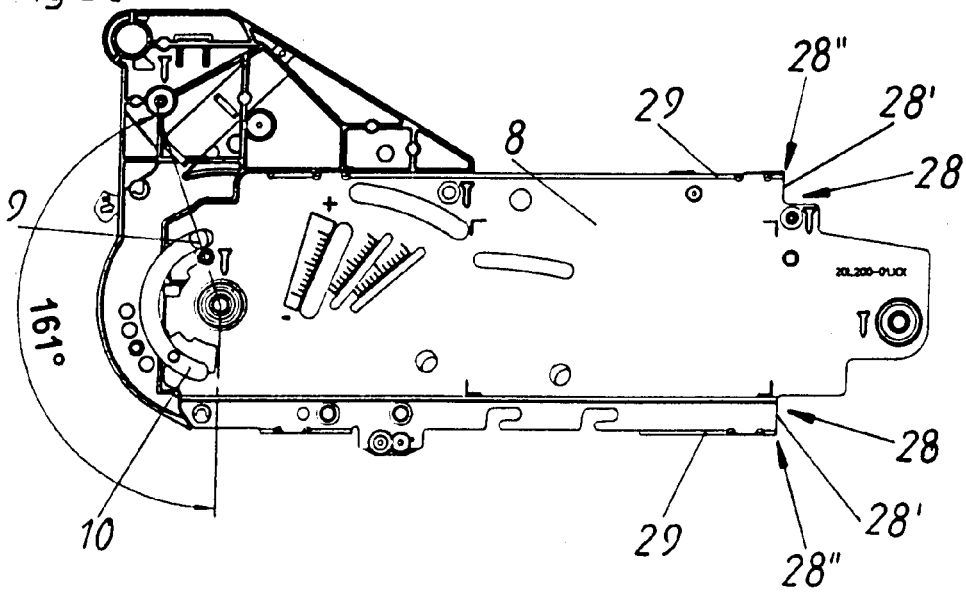

FIGS. 3*a* through 3*c* respectively show a side view of an embodiment of a mechanical actuating unit 8. Depending on which type of furniture flap is to be used, a corresponding actuating unit 8 is employed.

FIG. 3*a* shows a mechanical actuating unit 8 for an upwardly foldable flap. The angle range which can be covered from the closure position to the open position of the furniture flap 3 is 143° in this embodiment. The interface 9 which in the form of a receiving opening in the actuating arm 4 is disposed in that position in which the furniture flap 3 or the actuating arm 4 is in the open position. The force transmission device 11 can be brought into engagement with the interface 9. For the opening and closing movement of the actuating arm 4 the interface 9 and the force transmission device 11 move along the guide path 10.

The actuating unit 8 in FIG. 3*b* serves for movement of an upwardly pivotable flap (UPF). The angle range which can be covered in this embodiment is 151°. The interface 9 which is in the form of a receiving opening in the actuating arm 4 is in that position in which the furniture flap 3 or the actuating arm 4 is in the open position. Once again the force transmission device 11 of the electric drive 7 can be brought into engagement with the interface 9 and both are moved during the opening or closing movement, along the guide path 10.

FIG. 3*c* shows an actuating unit 8 for moving an upward lift flap (ULF). In this embodiment the angle range which can be covered is 161°. Once again the interface 9 which is in the form of a receiving opening is in that position in which the furniture flap 3 is in its open position. The force transmission device 11 is brought into engagement with the interface 9. Both move along the guide path 10 during the opening and closing movement.

In the open position the interface 9, depending on the respective type of flap used, is at various opening angles ϕ, whereby the position of the force transmission device 11 has to be appropriately adapted to be brought into engagement with the interface 9. That positional adaptation is effected in an embodiment of the invention with a locking lever 12 which in this embodiment is part of the locking device 27 and brings locking elements 14 into engagement with associated holding elements 25.

Figure 4:
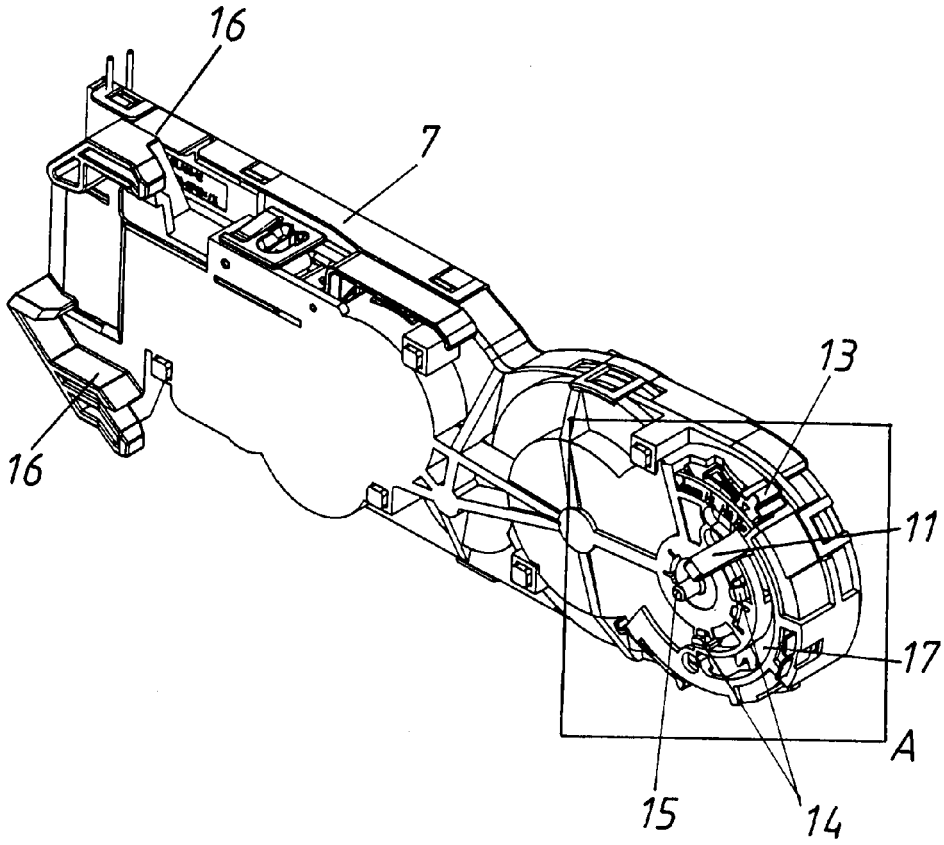
FIG. 4 shows a perspective view of an embodiment of an electric drive which can be fastened to the actuating units which are shown in FIGS. 3*a* through 3*c* and which are of a different configuration.

A perspective view in FIG. 4 shows an electric drive 7 which can be releasably fastened to various configurations of the actuating unit 8. In that respect, besides a centering pin 15 which can be pushed into an associated receiving opening 26 in the actuating unit 8, two holding noses 16 serve for releasable fixing, the noses 16 bearing against corresponding surfaces and edges 28', 28" of the actuating unit 8 and being partially supported there. Those surfaces and edges serve as abutment elements or abutment edges 28', 28" and by virtue of the support action at the same time form a bearing 28 in which the electric drive 7 can be suspended and about which the electric drive 7 is swivelable. The abutment elements or abutment edges 28', 28" serve as holding elements for the holding noses 16 of the electric drive 7 as soon as it is suspended in the actuating unit 8.

The actuating unit 8 has the force transmission device 11 which is inserted into the interface 9 in the form of the receiving opening and thereby brought into engagement. The locking lever 12 is provided with an actuating device 13 with which the force transmission device 11 is movable. The force transmission device 11 is partially displaced along a receiving opening 17 in the housing of the electric drive 7 by actuation of the actuating device 13, by the locking lever 12. The locking lever 12 is part of the locking device 27 and has locking elements 14 in the form of hooked projections for fixing or locking the electric drive 7 to the actuating unit 8.

Figure 5:
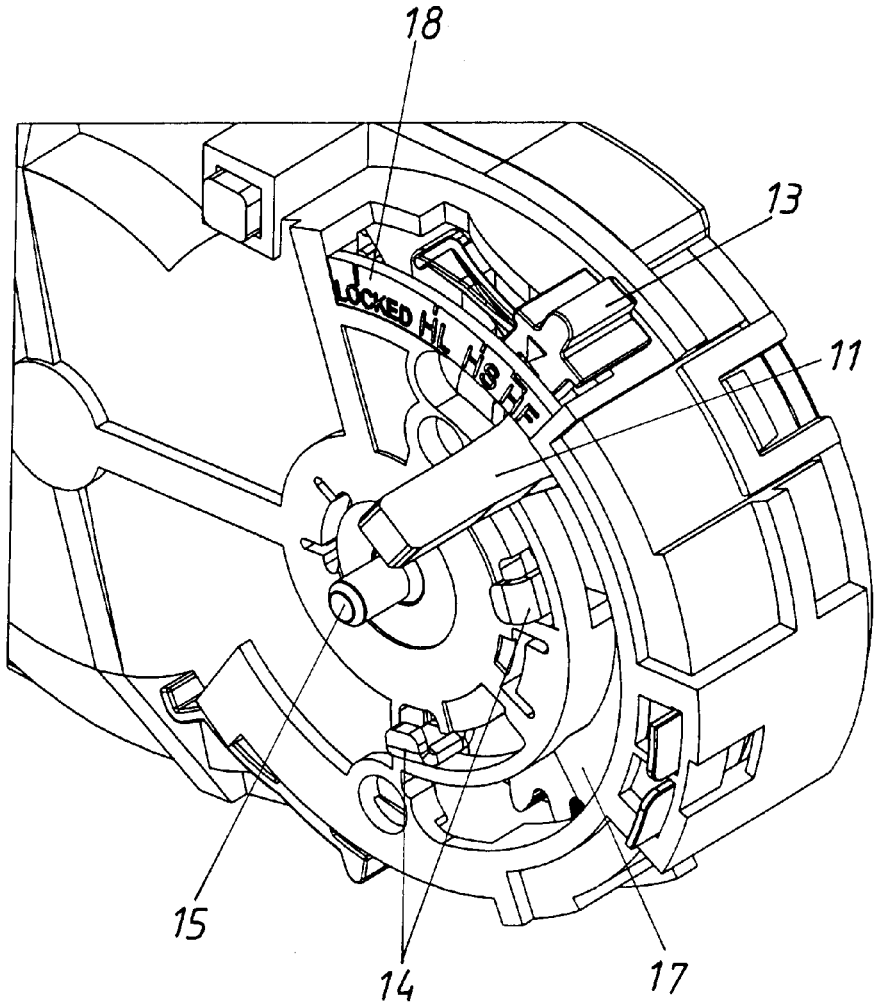
FIG. 5 shows a detail view of the portion marked with A in FIG. 4.

FIG. 5 shows a perspective view of the portion marked with A in FIG. 4. In this case the actuating device 13 can be displaced to different positions. Those positions are marked on a surface 18 ("HL" denoting ULF, "HF" denoting UFF and "HS" denoting UPF, and "LOCKED") and identify the various types of flap and the locking position. The first three positions are unlocked positions in which arrangement and release of the electric drive 7 on and from the actuating unit 8 is possible. Displacement of the actuating device 13 actuates the locking lever 12 which on the one hand displaces the force transmission device 11 for adaptation to the various positions of the interface 9, depending on the respective type of furniture flap, with the force transmission device 11 being partially displaced along the receiving opening 17. On the other hand the locking elements 14 are also moved in a housing opening 23 by rotation of the locking lever 12.

For mounting to an upwardly foldable flap (UFF) the actuating device 13 and therewith the force transmission device 11 for fastening the electric drive 7 to the actuating unit 8 is displaced furthest along the receiving opening 17 as that type of flap involves the smallest opening angle $\gamma$ of the three illustrated types of flap. To close the upwardly foldable flap the force transmission device 11 with the actuating arm 4 is moved from that starting point, that is to say from the position marked with "HF", downwardly along the receiving opening 17.

The upward lift flap involves the largest opening angle $\phi$ so that, for fastening the electric drive 7 to the actuating unit 8, the force transmission device 11 must be displaced in this case least along the guide path 17. To close the upward lift flap the force transmission device 11 is moved with the actuating arm 4 from that starting point, that is to say from the position marked by "HL", downwardly along the receiving opening 17.

Disposed therebetween is the marking for the upwardly pivotable flap. To close the upwardly pivotable flap the force transmission device 11 is moved with the actuating arm 4 from that starting position, that is to say from the position marked by "HS", downwardly along the receiving opening 17.

When now the electric drive 7 is fastened to the actuating unit 8 and pivoted towards it the actuating device is previously manually set to the respective type of flap. In that respect it can be provided that the locking lever 12 or the actuating device 13 comes into latching engagement at the respective position or that position can be felt in the displacement movement. With that displacement the force transmission device 11 is displaced in such a way that it can be pushed into the interface 9 in the form of the receiving opening at the actuating unit 8 which is possibly already fitted to the furniture carcass 2.

After fastening of the two components 7, 8 to each other the actuating device 13 can be displaced to the locking position. That position is identified by "LOCKED" on the marking surface 18. Two locking elements 14 which are in the form of hooked projections on the locking lever 12 are displaced by a displacement of the actuating device 13 to that position, to a position at which they come into engagement with abutment or holding elements 25 provided for that purpose on the actuating unit 8, representing a further part of the locking device 27. In that way the electric drive 7 can no longer be released from the actuating unit 8 because detachment of the electric drive 7 from the actuating unit 8 is prevented by the locking elements 14 and the abutment or holding elements 25. It is only when the actuating device 13 is removed from the "LOCKED" position again that release is possible.

Figure 6:
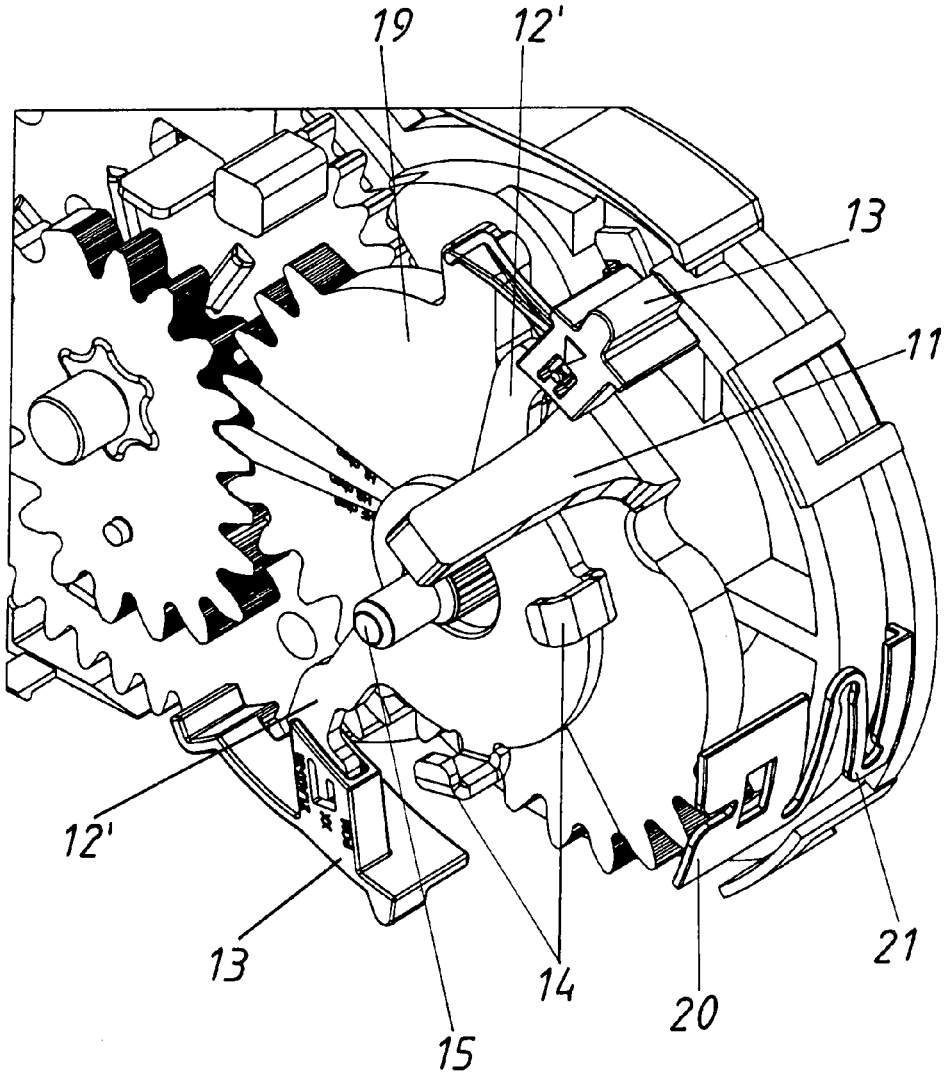
FIG. 6 shows a partly broken-away view of FIG. 5.

The partly broken-away perspective view in FIG. 6 shows the rotatably mounted locking lever 12 which has two mutually opposite actuating devices 13. The locking lever 12 is rotated by displacement of the actuating devices 13, whereby abutment elements 12' are displaced and thereby displaceably move the force transmission device 11. The force transmission device 11 in turn is arranged on an eccentric transmission gear 19. Locking elements 14 in the form of hooked projections which are also rotated upon rotation of the locking lever 12 are arranged on the locking lever 12. An indicator device 20 acted upon by a spring 21 serves to indicate whether the two components 7, 8 are correctly fastened together or locked.

Figure 7:
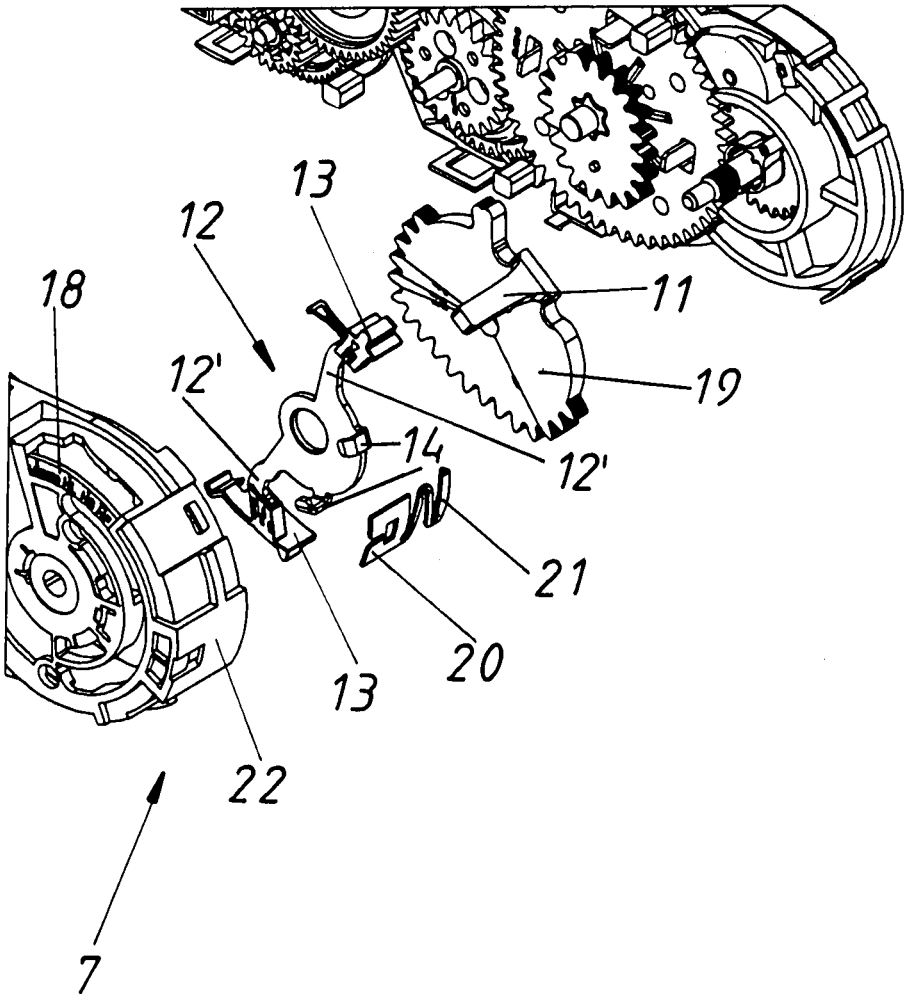
FIG. 7 shows an exploded view of a part of the components which are essential for the invention, of the electric drive.

The exploded view in FIG. 7 shows once again the components 7, 8 of the invention that are essential for locking. The force transmission device 11 is arranged on the eccentric transmission gear 19. The locking lever 12 has abutment elements 12' and locking elements 14 which are displaced by actuation of the actuating devices 13. The markings for the corresponding types of flap and the locking position are disposed on the housing 22 of the first component 7.

Figure 8A:
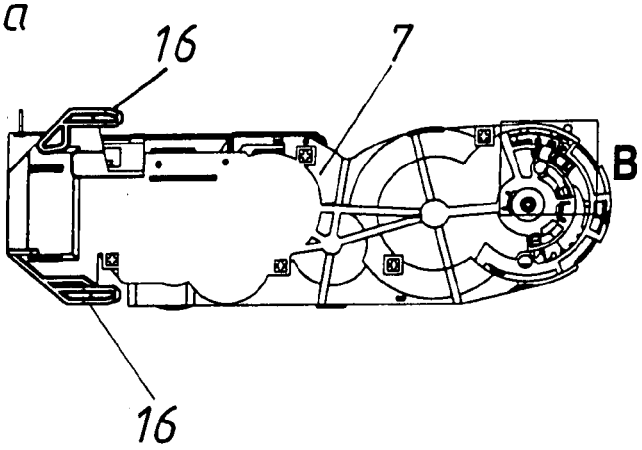
FIGS. 8*a* and 8*b* show a side view of an embodiment of an electric drive and a detail view of the portion marked with B in FIG. 8*a*, FIGS. 9*a* and 9*b* show the embodiment of the electric drive of FIG. 8, wherein the locking lever is adjusted in the locking position and a detail view of the portion marked with C in FIG. 9*a*.
Figure 8B:
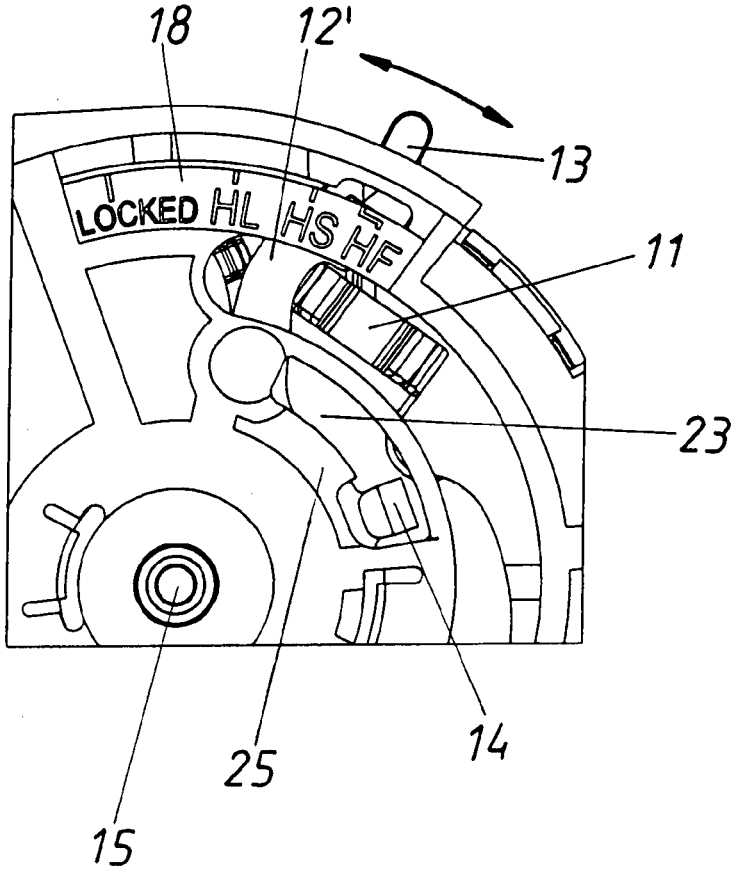

The detail view in FIG. 8*b* of the portion marked with B in FIG. 8*a*, showing a side view of an embodiment of the electric drive 7, illustrates how the actuating device 13 of the locking lever 12 is arranged in the position marked for the upwardly foldable flap. In this case the abutment element 12' of the locking lever 12 has displaced the force transmission device 11 into a suitable position. The locking element 14 is arranged in a receiving opening 23 in the housing 22 and is not in engagement with the holding or abutment element 25.

Figure 9A:
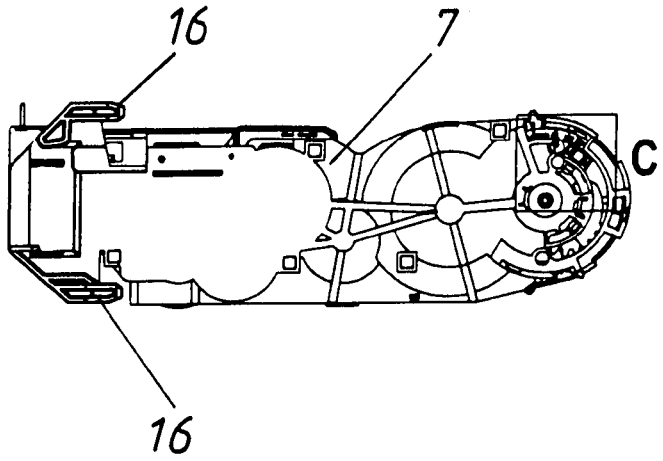
Figure 9B:
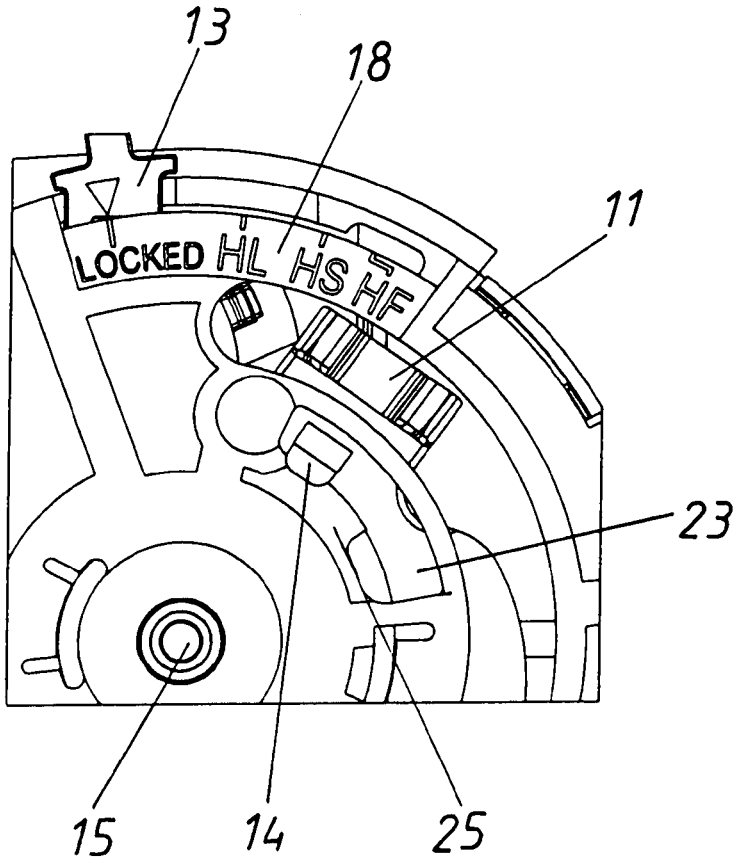

When the electric drive 7 and the actuating unit 8 are fastened together, the actuating device 13 is displaced to the position marked with "LOCKED" as shown in the detail view in FIG. 9*b* of the portion marked with C in FIG. 9*a*. The locking lever 12 and therewith the locking elements 14 are rotated by that displacement of the actuating device 13 whereby they have been brought into engagement with corresponding abutment or holding elements 25 of the second component 8 so that detachment of the electric drive 7 from the actuating unit 8 is no longer possible.

Figure 10:
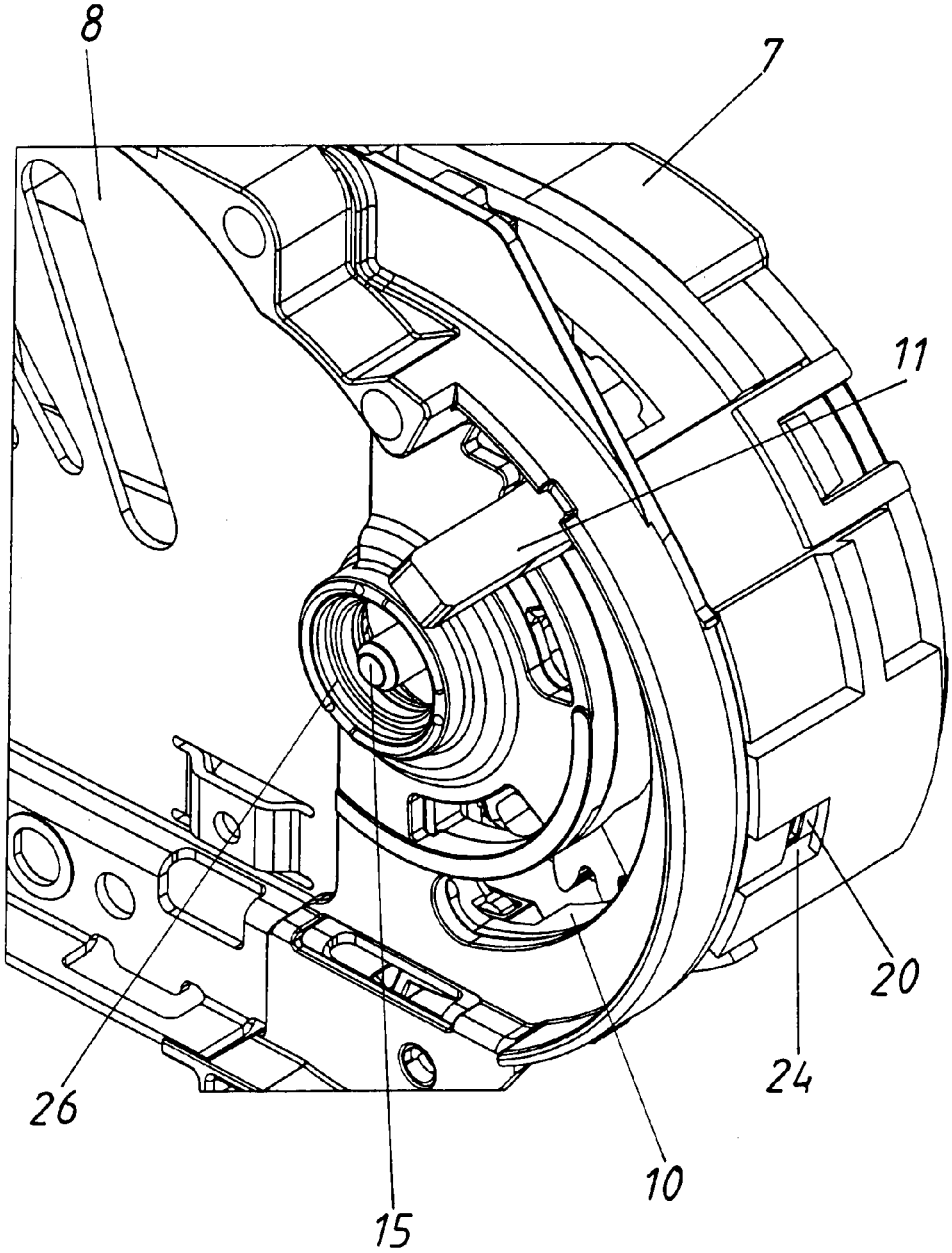
FIG. 10 shows a perspective detail view of the electric drive fastened to the actuating unit.

FIG. 10 shows a perspective detail view of the components 7 and 8 fastened together. It shows how the force transmission device 11 which is in the form of a shaft pin has been inserted into the interface 9 in the form of the receiving opening and has thereby come into engagement therewith. The electric motor now moves the force transmission device 11 along the guide path 10 whereby the actuating arm 4 is correspondingly moved. The indicator device 20 can be seen in a receiving opening 24 in the housing, indicating whether the electric drive 7 and the actuating unit 8 are correctly fastened together or locked. The centering pin 15 is inserted into an associated receiving opening 26 for play-free positioning.

Figure 11A:
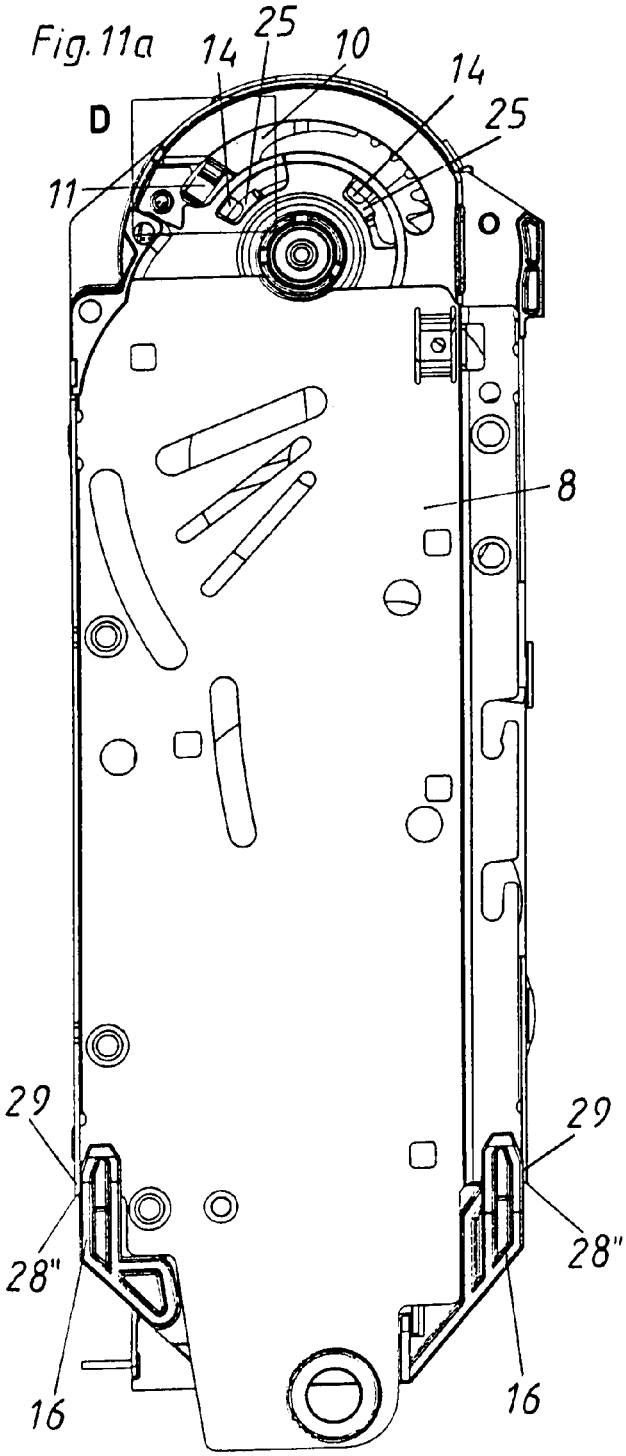
FIGS. 11*a* through 11*c* show a side view and a front view of an embodiment of an electric drive fastened to an actuating unit and a detail view of the portion marked with D in FIG. 11*a*, FIGS. 12*a* through 12*d* show three perspective views and a plan view of a furniture flap drive according to the invention, wherein the electric drive and the actuating unit are still completely separated from each other.
Figure 11B:
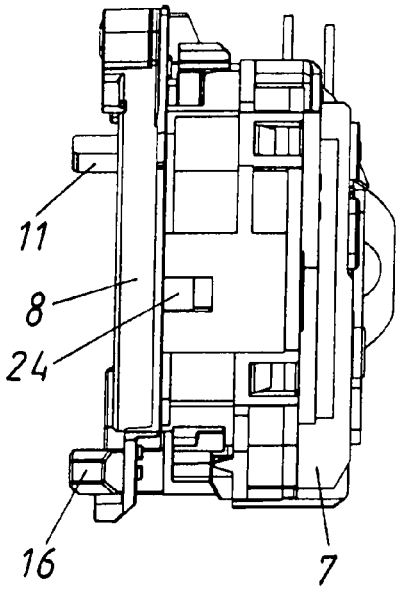
Figure 11C:
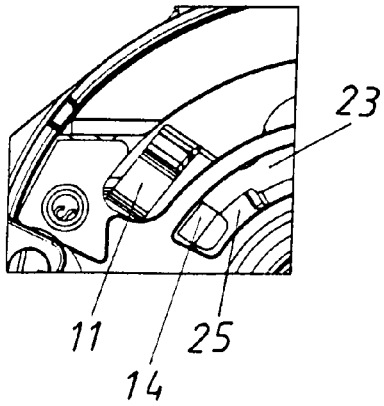

FIGS. 11*a* through 11*c* again show the components 7 and 8 fastened together. As can be seen the locking elements 14 are in engagement with corresponding abutment or holding elements 25. The force transmission device 11 is also in engagement with the interface 9 and the holding noses 16 are in engagement with abutment elements or abutment edges 28', 28" and bear against the abutment elements or the abutment edges 28', 28" and the surfaces of the actuating unit 8, that are adjacent to the abutment edges 28', 28".

Figure 12A:
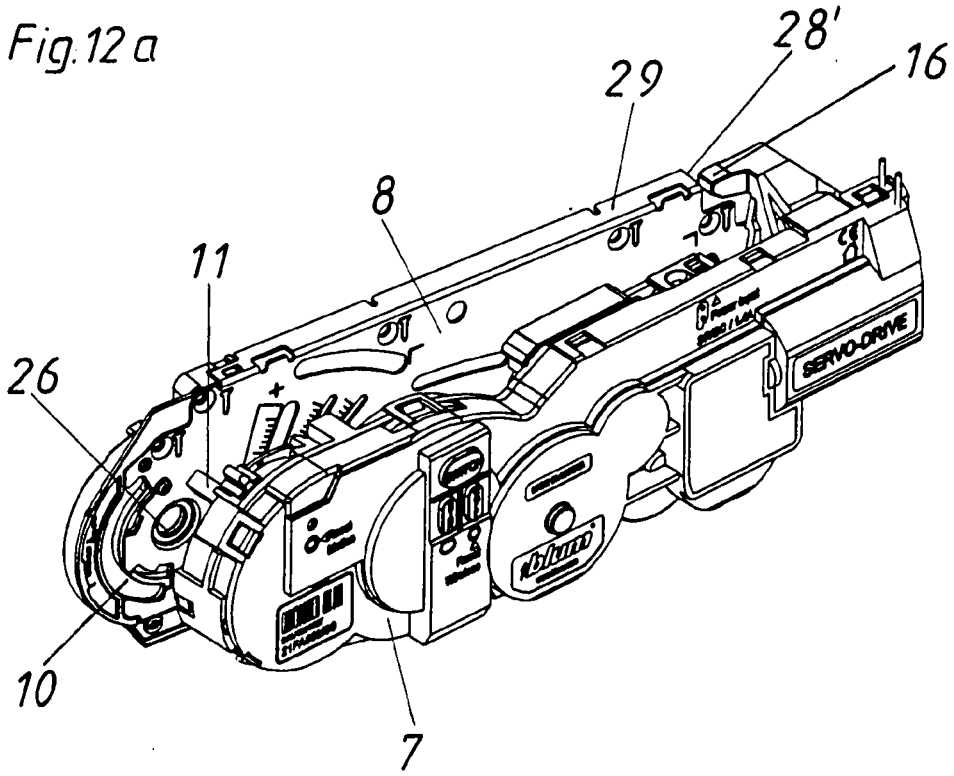
Figure 12B:
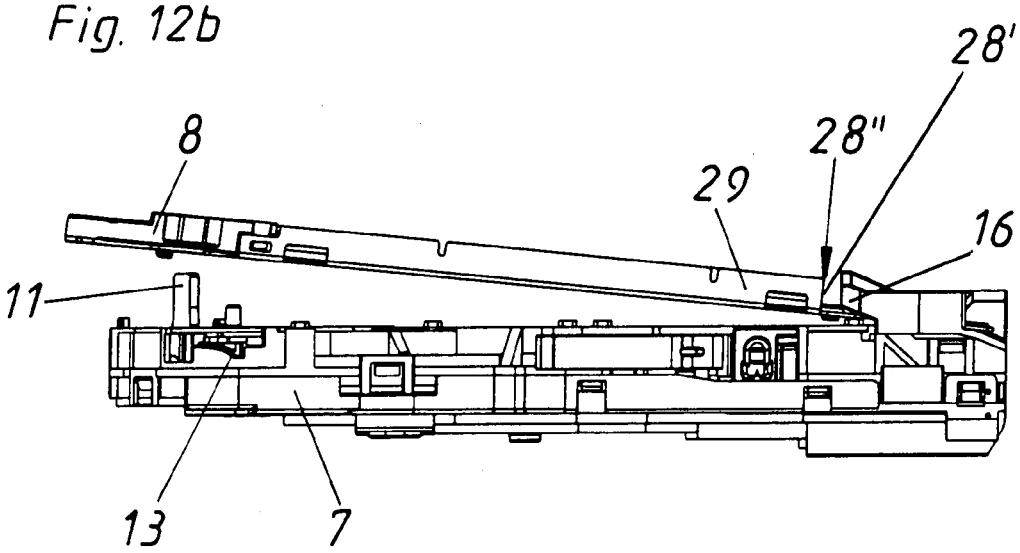

FIG. 12*a* shows that situation in which the electric drive 7 and the actuating unit 8 are still completely separated. FIG. 12*a* shows that as a perspective view while FIG. 12*b* shows a plan view of that situation. The electric drive 7 has two holding noses 16 which can be brought into engagement with abutment edges 28', 28" and with surfaces of the actuating unit 8, that are adjacent to the abutment edges 28', 28" and serve as abutment elements. In this case both the terminal edge 28' of a horizontal limb 29 and also the edge 28" arranged perpendicularly thereto serve as abutment edges 28', 28". The edges 28', 28" and the surfaces of the actuating unit 8, that adjoin same and against which the holding noses 16 bear, serve as abutment elements and as a bearing 28 about which the electric drive 7 is swivelable towards the actuating unit 8, in which case the holding noses 16 bear against the abutment elements.

Figure 12C:
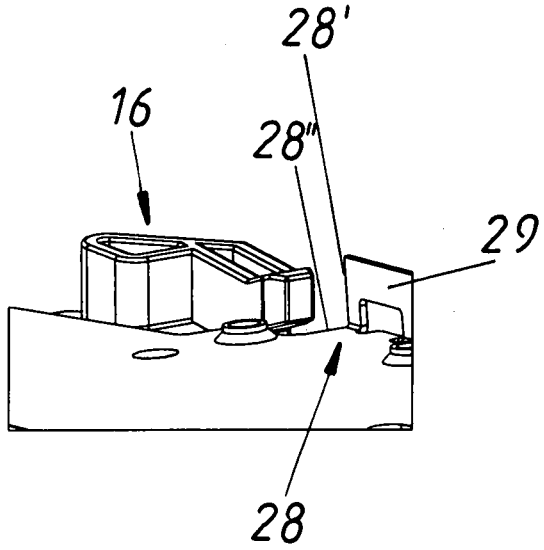

FIG. 12*c* shows a perspective detail view of one of the holding noses 16 with the associated abutment edges 28', 28" which are formed both as the edge of the horizontal limb 29 and also the surface perpendicularly thereto, wherein the holding noses 16 bear against those surfaces in the engaged condition of the electric drive 7 and are supported there in particular for the pivotal movement. Those regions therefore serve together with the abutment edges 28', 28" as the bearing 28.

Figure 12D:
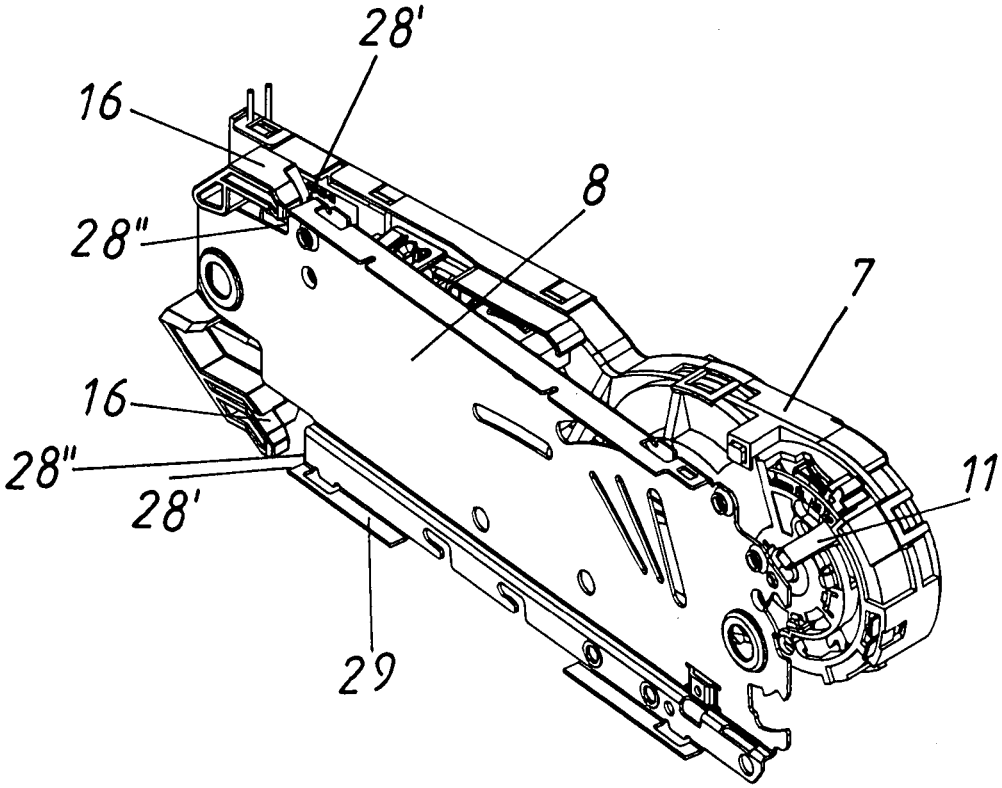

A further perspective view is shown in FIG. 12*d*. The horizontal limb 29 serving as the abutment or holding element and the abutment edges 28', 28" can be particularly clearly seen here.

Figure 13A:
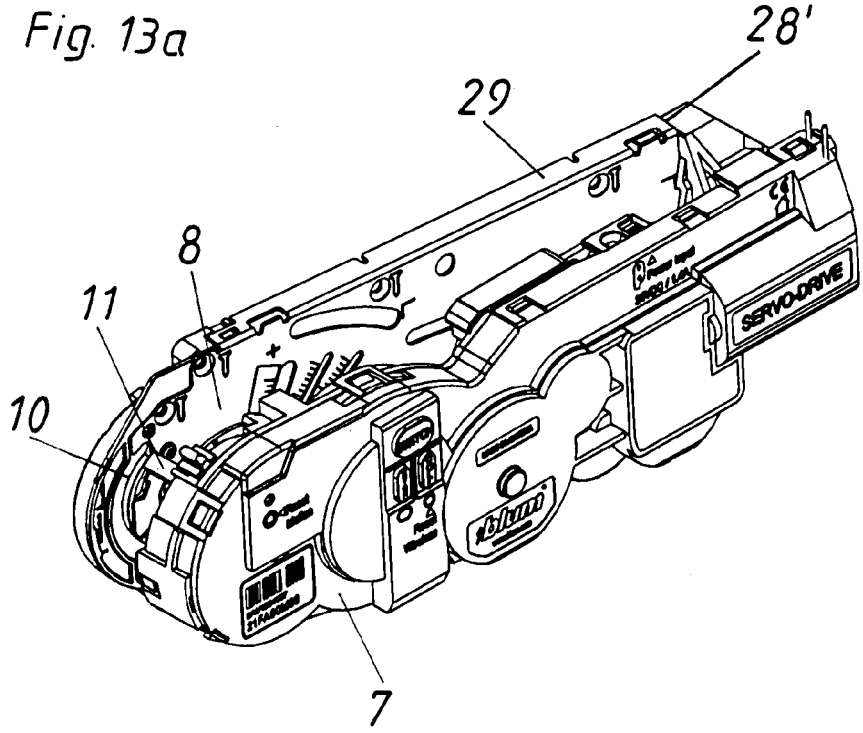
FIGS. 13*a* through 13*e* show four perspective views and a plan view of the furniture flap drive of FIG. 12, wherein the electric drive is engaged into the actuating unit.

FIG. 13*a* shows a perspective view illustrating how the electric drive 7 and the actuating unit 8 are at least partially connected, wherein the holding noses 16 have been brought into engagement with the abutment elements which in this case are formed by the horizontal limb 29 and the transverse surface arranged perpendicularly thereto and the abutment edges 28', 28". In this condition the electric drive 7 is suspended in the actuating unit 8. Those region against which the holding noses 16 bear serve as the bearing 28 about which the electric drive 7 is now pivoted towards the actuating unit 8, starting from the condition illustrated here.

Figure 13B:
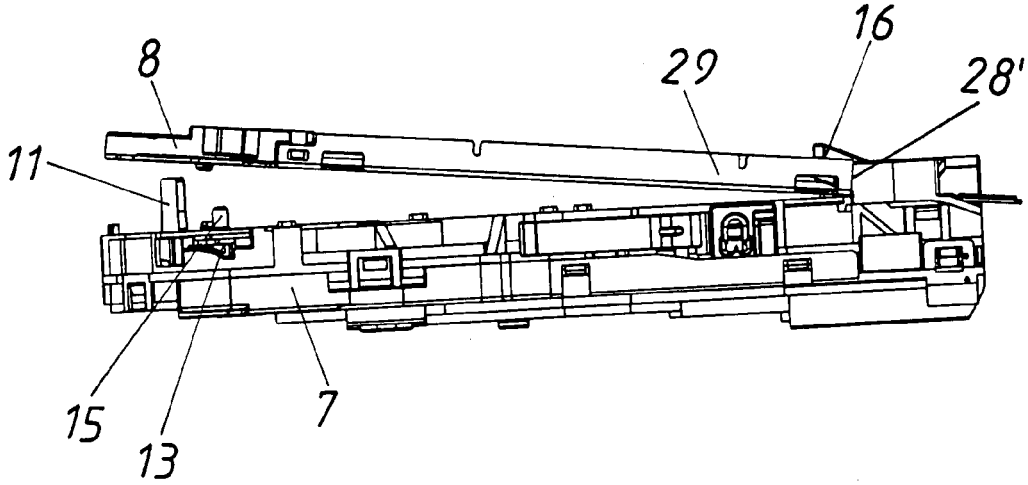
Figure 13C:
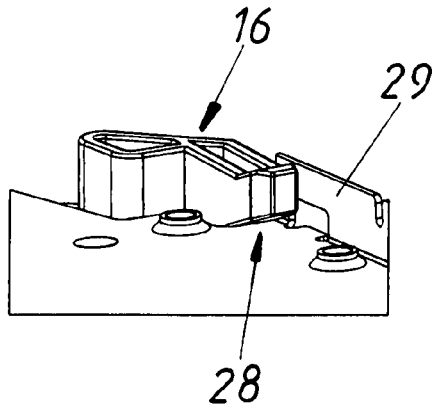
Figure 13D:
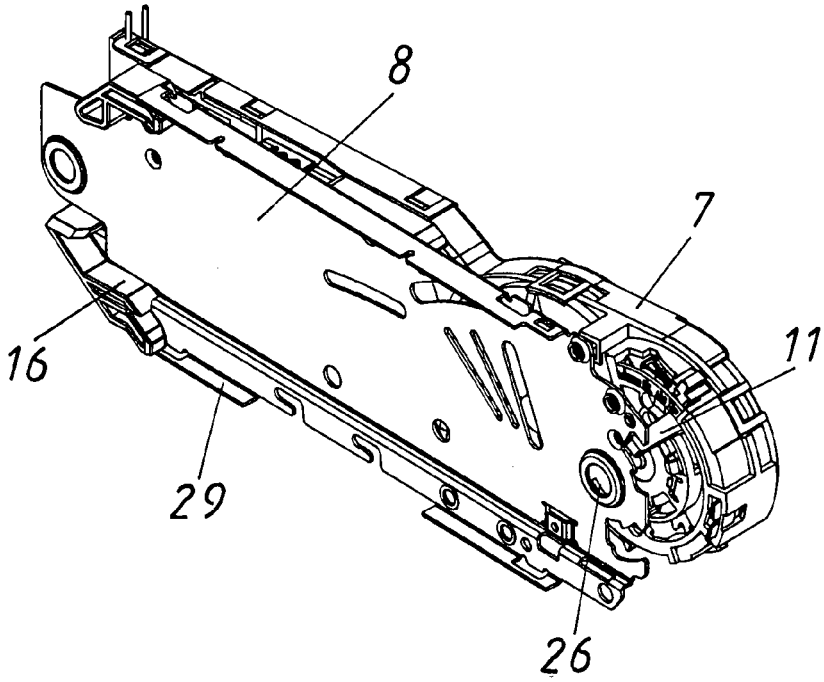

FIG. 13*b* shows that condition as a plan view while FIG. 13*c* as a perspective detail view shows how one of the holding noses 16 bears both against the horizontal limb 29 and also against the transverse surface arranged perpendicularly thereto. This can also be seen in the perspective view in FIG. 13*d*.

Figure 13E:
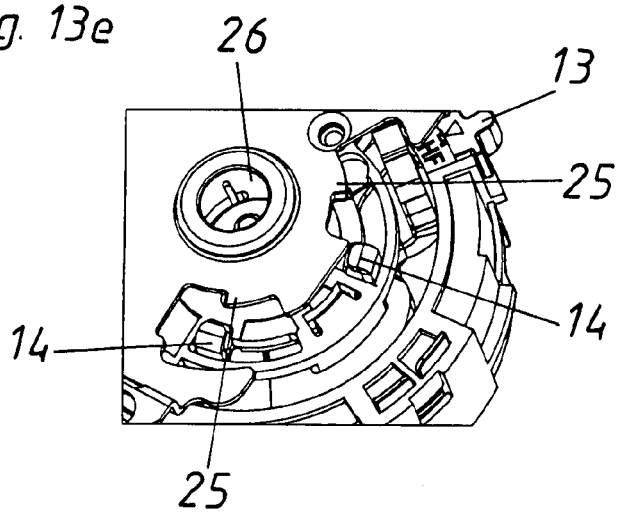

FIG. 13*e* shows a perspective detail view of a part of the locking device 27 which includes a locking lever 12 with locking elements 14 arranged thereon, which are disposed on or in the electric drive 7. The locking elements 14 come into engagement with holding elements 25 by actuation of the locking lever 12 by means of the actuating device 13. A centering pin 15 arranged on the electric drive 7 is inserted into an opening 26 of the actuating unit 8 during the pivotal movement and serves as a play-free positioning means. The force transmission device 11 is inserted into an interface in the form of a receiving opening 9. During the opening and closing movement the force transmission device 11 moves along the guide path 10 and in so doing moves the actuating arm 4 for opening or closing the furniture flap 3.

Figure 14A:
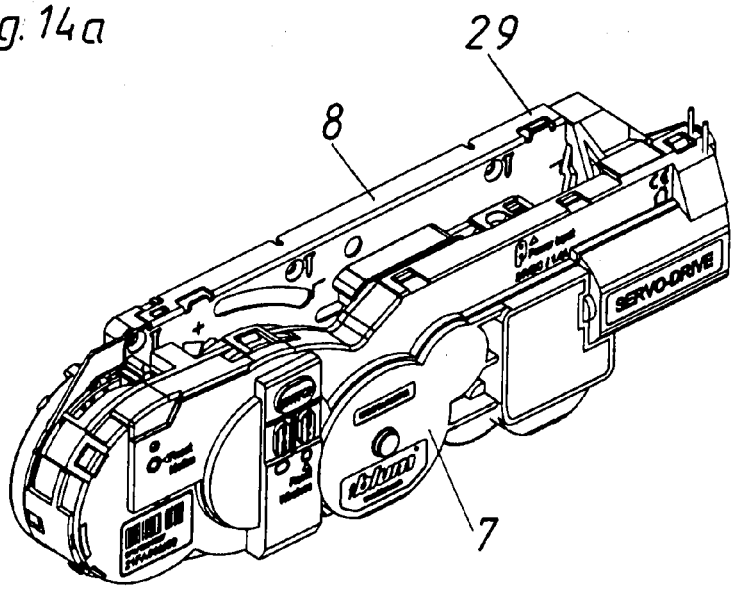
FIGS. 14*a* through 14*e* show four perspective views and a plan view of the furniture flap drive of FIG. 12, wherein the electric drive and the actuating unit are connected and locked, and FIGS. 15*a* and 15*b* each show a perspective view of a furniture carcass with a mounted furniture flap drive for a specific type of furniture flap.
Figure 14B:
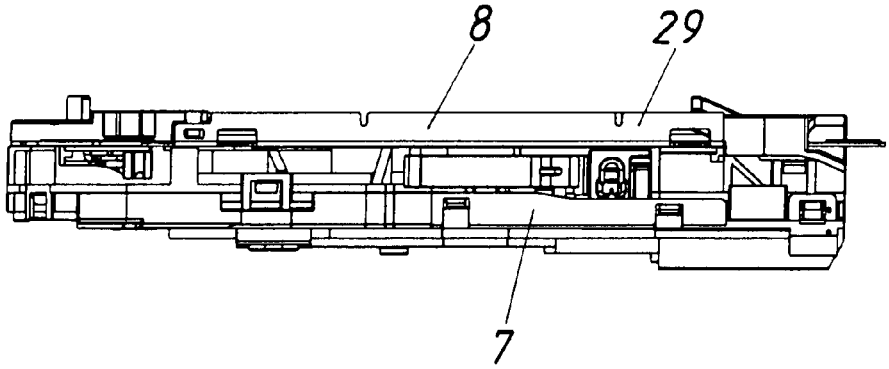

FIG. 14*a* shows a perspective view of the actuating unit 8 and the electric drive 7 of the furniture flap drive 1 in the connected condition. FIG. 14*b* shows a plan view thereof.

Figure 14C:
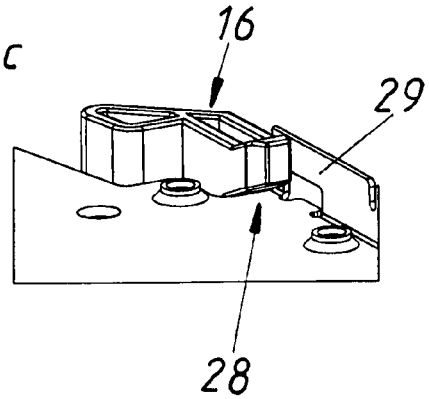
Figure 14D:
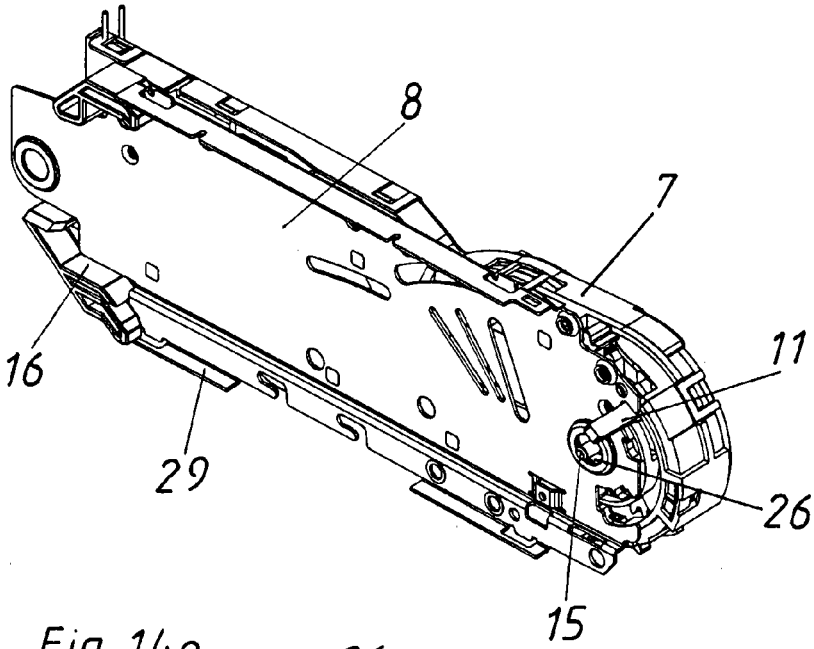

FIG. 14*c* in turn shows the bearing at which the holding noses 16 of the electric drive 7 bear against abutment elements. FIG. 14*d* shows a further perspective view thereof. It can also be seen here how the force transmission device 11 is arranged in the guide path 10 in which the force transmission device 11 is movable. The centering pin 15 is arranged in the associated receiving opening 26.

Figure 14E:
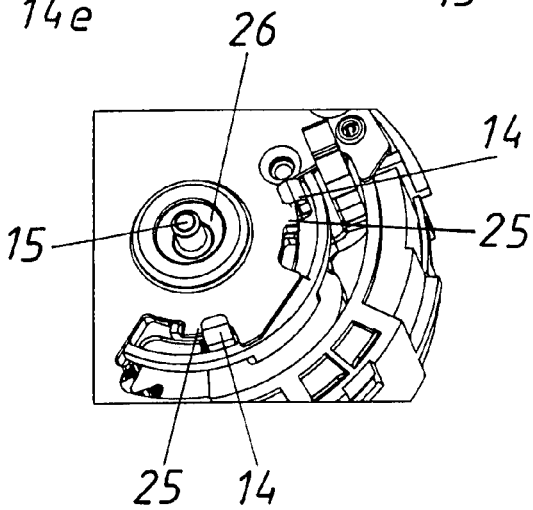

FIG. 14*e* is a perspective detail view showing how the locking device 27 locks the actuating unit 8 and the electric drive 7 in the connected position. The locking elements 14 are displaced by the locking lever 12 in such a way that they are brought into engagement with abutment elements 25 so that release, that is to say detachment, of the electric drive 7 from the actuating unit 8 is prevented. The centering pin 15 is inserted into the associated receiving opening 26.

Figure 15A:
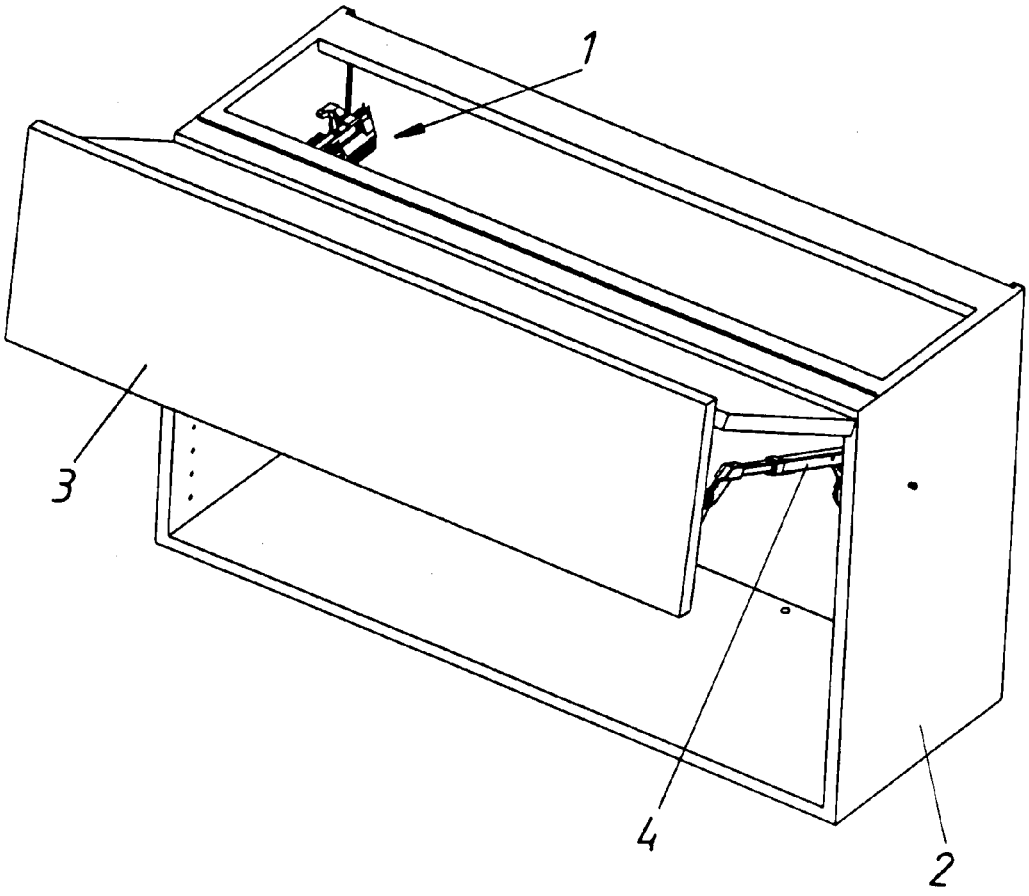

FIG. 15*a* shows a furniture carcass 2 with a furniture flap 3 mounted movably thereto in the form of an upwardly foldable flap, and a furniture flap drive 1 as shown in FIGS. 1 through 14. Upwardly foldable flaps are flaps 3 which are of a two-part structure, wherein a first flap portion is rotatably connected to the furniture carcass 2 and a second flap portion is rotatably connected to the first flap portion. When the flap 3 is moved into the open position the first flap portion is pivoted upwardly away from the furniture carcass 2 while the second flap portion is also pivoted upwardly towards the furniture carcass 2 so that the flap 3 is folded together in the open position.

Figure 15B:
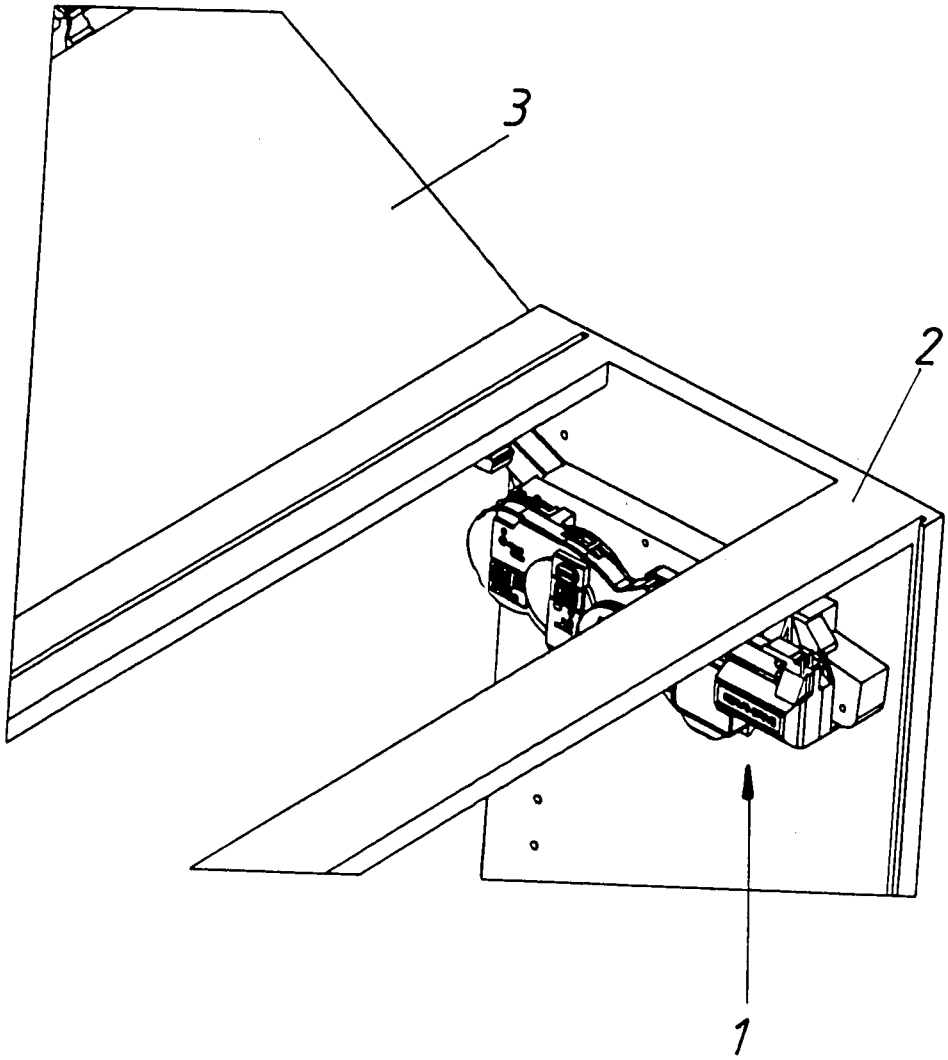

FIG. 15*b* shows a perspective detail view of FIG. 15*a* viewing in another direction.

The invention is not limited to the illustrated embodiments but embraces all technical equivalents which can fall within the scope of the appended claims.

The positional references adopted in the description such as for example up, down, lateral and so forth are also related to the directly described and illustrated Figure and are to be appropriately transferred to the new position upon a change in position.

The invention claimed is:

1. A furniture flap drive comprising:

an electric drive having an electric motor;

a mechanical actuating unit having an actuating arm which pivots about a rotational axis;

a centering device provided on the actuating unit or the electric drive by which the actuating unit and the electric drive can be positioned precisely for fastening purposes;

a bearing by which the electric drive can be suspended such that the suspended electric drive is swivelable about the bearing towards the actuating unit; and a locking device, wherein the actuating unit and the electric drive are separate components and can be releasably fastened together, wherein the locking device is remote from the bearing, and the electric drive can be locked to the actuating unit with the locking device after the electric drive swivels onto the actuating unit, wherein the actuating unit has a long axis which points in the direction of the longitudinal extent of the actuating unit, wherein the actuating unit has a short axis which is perpendicular to the long axis of the actuating unit and perpendicular to the rotational axis of the actuating arm, wherein the bearing is configured such that the suspended electric drive is swivelable about the short axis of the actuating unit toward the actuating unit, wherein the centering device includes a centering pin and a receiving opening, the centering pin protruding from one of the actuating unit and the electric drive, and the receiving opening being defined in the other of the actuating unit and the electric drive, wherein the centering pin can be inserted into the receiving opening for precise positioning of the actuating unit and the electric drive, and wherein the bearing is configured to allow translational movement of the electric drive in a direction perpendicular to the short axis while the electric drive is swiveling about the short axis so as to allow alignment of the centering pin and the receiving opening.

2. The furniture flap drive of claim 1, wherein the bearing comprises at least one holding nose which allows translational movement of the electric drive in a direction orthogonal to the short axis while the electric drive is swiveling.

3. The furniture flap drive of claim 1, wherein the locking device is in the form of a mechanical latching connection.

4. The furniture flap drive of claim 3, wherein the mechanical latching connection is adapted to be self-latching.

5. The furniture flap drive of claim 3, wherein parts of the locking device are resilient or are spring-loaded.

6. The furniture flap drive of claim 3, further comprising a latching pawl, wherein the mechanical latching connection is adapted to be self-latching via the latching pawl.

7. The furniture flap drive of claim 1, wherein a holding element is arranged at the electric drive, wherein the locking device has at least one locking element which is arranged on the actuating unit and which can be brought into engagement with the holding element, and wherein the at least one locking element prevents swiveling movement of the suspended electric drive away from the actuating unit.

8. The furniture flap drive of claim 7, wherein the at least one locking element is mounted rotatably and is actuable via an actuating device to be brought into engagement with the associated holding element by rotation.

9. The furniture flap drive of claim 7, wherein the at least one locking element is actuable by a locking lever.

10. The furniture flap drive of claim 1, wherein the bearing comprises an abutment element and a holding nose which engages the abutment element to suspend the electric drive, and wherein the abutment element is arranged on the actuating unit and the holding nose is arranged on the electric drive.

11. The furniture flap drive of claim 10, wherein the bearing allows translational movement of the electric drive in a direction orthogonal to the short axis while the electric drive is swiveling.

12. The furniture flap drive of claim 1, wherein the bearing comprises an abutment element and a holding nose which engages the abutment element to suspend the electric drive, and wherein the abutment element is arranged on the electric drive and the holding nose is arranged on the actuating unit.

13. The furniture flap drive of claim 12, wherein the bearing allows translational movement of the electric drive in a direction orthogonal to the short axis while the electric drive is swiveling.

14. An article of furniture comprising:

a furniture carcass; and a flap mounted movably to the furniture carcass, wherein the furniture flap drive of claim 1 is mounted to the furniture carcass, and wherein the actuating arm of the furniture flap drive is connected to the flap.

15. The furniture flap drive of claim 1, wherein the centering device is configured such that a longitudinal axis of the centering pin is perpendicular to the short axis and the long axis of the actuating unit when the actuating unit and the electric drive are fastened together.

16. The furniture flap drive of claim 1, wherein a holding element is arranged at the actuating unit, wherein the locking device has at least one locking element which is arranged on the electric drive and which can be brought into engagement with the holding element, and wherein the at least one locking element prevents swiveling movement of the suspended electric drive away from the actuating unit.

17. A furniture flap drive comprising:

an electric drive having an electric motor;

a mechanical actuating unit having an actuating arm;

a centering device provided on the actuating unit or the electric drive by which the actuating unit and the electric drive can be positioned precisely for fastening purposes;

a bearing by which the electric drive can be suspended such that the suspended electric drive is swivelable about the bearing towards the actuating unit; and a locking device, wherein the actuating unit and the electric drive are separate components and can be releasably fastened together, wherein the locking device is remote from the bearing, and the electric drive can be locked to the actuating unit with the locking device after the electric drive swivels onto the actuating unit, wherein the actuating unit has a long axis which points in the direction of the longitudinal extent of the actuating unit, wherein the actuating unit has a short axis which is perpendicular to the long axis of the actuating unit, wherein the suspended electric drive is swivelable about the short axis of the actuating unit toward the actuating unit, wherein the centering device includes a centering pin and a receiving opening, the centering pin protruding from one of the actuating unit and the electric drive, and the receiving opening being defined in the other of the actuating unit and the electric drive, wherein the centering pin can be inserted into the receiving opening for precise positioning of the actuating unit and the electric drive, wherein the bearing is configured to allow translational movement of the electric drive while the electric drive is swiveling so as to allow alignment of the centering pin and the receiving opening, wherein a holding element is arranged at the actuating unit, wherein the locking device has at least one locking element which is arranged on the electric drive and which can be brought into engagement with the holding element, and wherein the at least one locking element prevents swiveling movement of the suspended electric drive away from the actuating unit.

18. The furniture flap drive of claim 17, wherein the at least one locking element is mounted rotatably and is actuable via an actuating device to be brought into engagement with the associated holding element by rotation.

19. The furniture flap drive of claim 17, wherein the at least one locking element is actuable by a locking lever.

20. A furniture flap drive comprising:

an electric drive having an electric motor;

a mechanical actuating unit having an actuating arm which pivots about a rotational axis;

a centering device provided on the actuating unit or the electric drive by which the actuating unit and the electric drive can be positioned precisely for fastening purposes;

a bearing by which the electric drive can be suspended such that the suspended electric drive is swivelable about the bearing towards the actuating unit; and a locking device, wherein the actuating unit and the electric drive are separate components and can be releasably fastened together, wherein the locking device is remote from the bearing, and the electric drive can be locked to the actuating unit with the locking device after the electric drive swivels onto the actuating unit, wherein the actuating unit has a long axis which points in the direction of the longitudinal extent of the actuating unit, wherein the actuating unit has a short axis which is perpendicular to the long axis of the actuating unit and perpendicular to the rotational axis of the actuating arm, wherein the bearing is configured such that the suspended electric drive is swivelable about the short axis of the actuating unit toward the actuating unit, wherein the centering device includes a centering pin and a receiving opening, the centering pin protruding from one of the actuating unit and the electric drive, and the receiving opening being defined in the other of the actuating unit and the electric drive, wherein the centering pin can be inserted into the receiving opening for precise positioning of the actuating unit and the electric drive, wherein the bearing comprises two holding noses which engage two abutment elements, respectively, wherein the holding noses are spaced apart from each other in a direction parallel to the short axis, and the two abutment elements are spaced apart from each other in a direction parallel to the short axis, and wherein the holding noses and the abutment elements are configured to support the electric drive while the electric drive is swiveling about the short axis and to allow translational movement of the electric drive in a direction perpendicular to the short axis while the electric drive is swiveling about the short axis so as to allow alignment of the centering pin and the receiving opening.

* * * * *